US009642441B1

(12) United States Patent
Ajootian

(10) Patent No.: US 9,642,441 B1
(45) Date of Patent: May 9, 2017

(54) MULTI-PROPERTY APPLICATOR ASSEMBLY AND METHODS OF USE

(75) Inventor: Janice K. Ajootian, Woonsocket, RI (US)

(73) Assignee: JKA, Inc., Woonsocket, RI (US)

( * ) Notice: Subject to any disclaimer, the term of this patent is extended or adjusted under 35 U.S.C. 154(b) by 1307 days.

(21) Appl. No.: 12/556,632

(22) Filed: Sep. 10, 2009

(51) Int. Cl.
*A45D 40/26* (2006.01)
*A45D 34/04* (2006.01)

(52) U.S. Cl.
CPC ..... *A45D 40/262* (2013.01); *A45D 34/042* (2013.01)

(58) Field of Classification Search
USPC ..... 132/320, 218, 313, 317, 112–116; 15/160, 207.2, 159.1, 168; 401/282, 283, 401/268
See application file for complete search history.

(56) References Cited

U.S. PATENT DOCUMENTS 2,674,759 A * 4/1954 Solberg ..... 15/193
4,088,413 A * 5/1978 Rossignol de la Ronde et al. ..... 401/282
4,483,036 A * 11/1984 Sayklay ..... 15/160
4,756,039 A * 7/1988 Pardo ..... 15/160
4,998,315 A * 3/1991 Pessis ..... 15/160
5,220,702 A * 6/1993 Howell et al. ..... 15/160
5,450,865 A * 9/1995 Park ..... 132/218
5,507,063 A * 4/1996 Hirsch ..... 15/160
6,367,114 B1 * 4/2002 Babkowski ..... 15/207.2
D571,105 S * 6/2008 Godin ..... D4/119
D625,522 S * 10/2010 Riaz ..... D4/135
D632,089 S * 2/2011 Limongi ..... D4/135
7,895,698 B2 * 3/2011 Mink ..... 15/207.2
D654,700 S * 2/2012 Pope ..... D4/135
2004/0003478 A1 * 1/2004 Mink ..... 15/160

* cited by examiner

*Primary Examiner* — Robyn Doan
(74) *Attorney, Agent, or Firm* — IP Attorneys Group, LLC

(57) ABSTRACT

An applicator assembly having an application element, a blending element and a retaining element. The application element comprises a material configured to retain an application material and distribute the application material onto a surface and the blending element comprises a material configured to distribute the application material on the surface. Together the application and blending elements allow the process of transferring, distributing and blending the application material onto the surface to be performed with a single application assembly. Embodiments of the applicator assembly have the application element and the blending element to be comprised of materials with different characteristics.

3 Claims, 7 Drawing Sheets

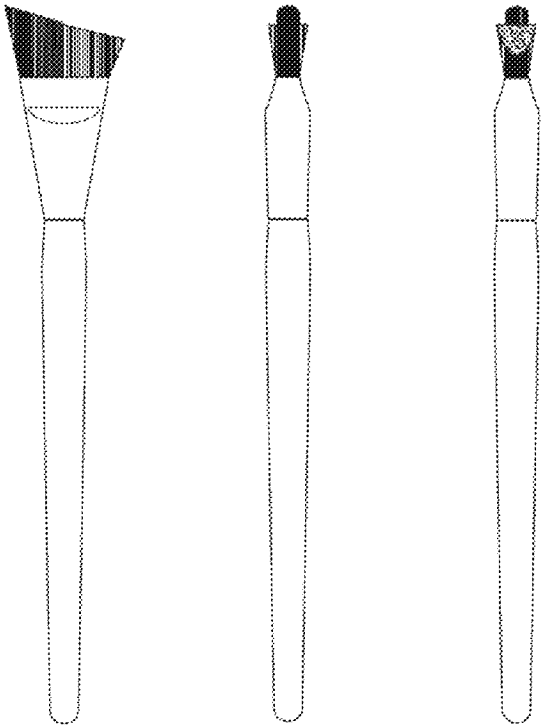
FIG. 2B
FIG. 2C
FIG. 2D
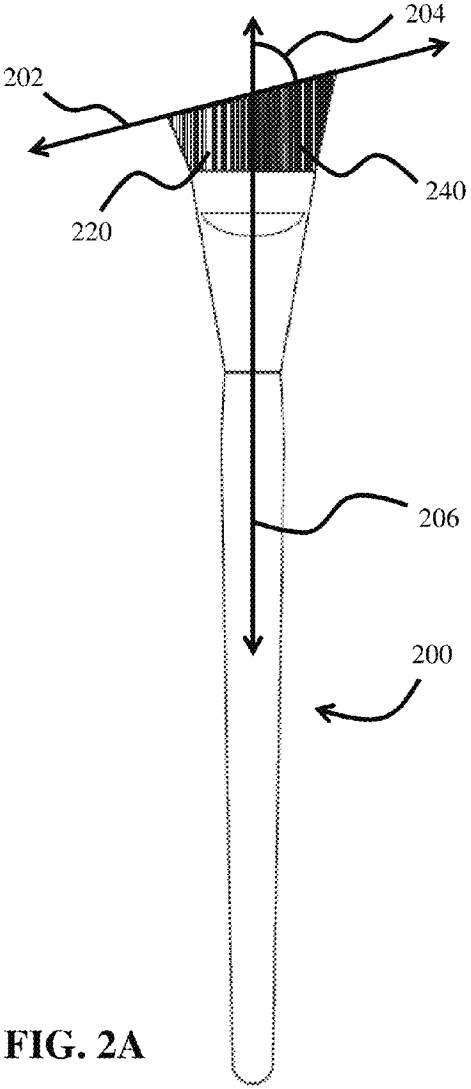
FIG. 2A

MULTI-PROPERTY APPLICATOR ASSEMBLY AND METHODS OF USE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

Field of the Invention

This invention relates to applicators, in particular sponges and brushes distribute an application material such as makeup or paint onto a surface.

Description of the Prior Art

In the field of sponge and brush applicators, it is known that different materials have different properties for the application and distribution of application materials such as paints or cosmetics.

Natural application materials, such a bristles, whether of vegetable or animal origin, result from organic growth processes wherein elongated cellular formations build upon one another to form essentially rod-like structures of sufficient resilience and integrity to serve the functional needs required in brushes for painting, powdering, scrubbing, sweeping and the like. It is the cellular wall formation that provides structural character to these natural bristles along with the complex chemical makeup of the specific bristle. Some natural bristles are essentially tapered in that one end of the bristle is larger than the other. Others are not tapered or have very little of this tendency. Natural bristles are mostly irregular in shape along their length, and have scale-like outer surfaces. Some of these are naturally split at the end, forming tiny fingers which are useful in brush performance.

The use of the natural bristles, such as animal hair bristles however, has several significant drawbacks. Inconsistent supplies of natural bristles and unacceptable variations from one batch of bristles to another often impede manufacture of brushes having natural bristles. Natural bristles may also need to be treated for hygienic purposes to eliminate the presence of contaminants. Even if properly treated, many individuals are nevertheless allergic to natural bristles. In addition, natural bristles can be damaged by cleansing agents used to clean the bristles after use.

In view of these problems associated with the use of natural bristles, various attempts have been made to replace natural bristles with synthetic materials such as synthetic filaments made, for example, from polyamides (such as nylon) and polyesters. The use of synthetic bristles has also met with difficulties, however. Synthetic bristle materials usually have little of the cellular structures, shape irregularities or scale-like surfaces. Rather, they have dense polymeric structure and are highly uniform in shape, with smooth surfaces. Synthetic bristles are available in tapered or untapered form, and in cross-sectional profiles of solid round, hollow round, ribbed, S shaped and other shapes dependent on extrusion technology. Many synthetic materials require physical splitting of the ends (flagging) where this is deemed desirable in brushes and do not have the softness, texture and overall appearance of natural bristles.

Advances have been made where synthetic material more closely resemble the characteristics of natural materials. For example, synthetic bristles have advanced such that in the extrusion melt or process of a synthetic filament, certain other additives, sometimes called foaming or blowing agents, including nucleating materials, create tiny gaseous bubbles or other irregularities at random locations within the extruding filaments. In addition, blowing agents can be use in plastic parts manufactured by extrusion, injection and compression molding and other conventional plastic fabricating processes.

In addition to synthetic bristles resilient porous resilient materials such as sponges or foams may be used a material to comprise the application or blending elements.

In the field of cosmetics, these natural and synthetic materials have been used to apply cosmetics. For particular cosmetic uses, such as a typical Foundation Brush, these applicators are designed to retain powder, liquid or cream material from the material holder such as a compact and allow the user to transfer that material to the skin. The properties of the brush help retain the material and distribute it on the skin. A Blending Brush is used to blend the eye shadow color by moving the brush across the skin. This additional distribution of the material moves the liquid or powder around to make the color more even, and enables control over intensity and merging multiple colors in with one another.

BRIEF SUMMARY OF THE INVENTION

In one embodiment, the present apparatus comprises an applicator assembly having an application element, a blending element and a retaining element. The application element comprises a material configured to retain an application material and distribute the application material onto a surface and the blending element comprises a material configured to distribute the application material on the surface. Together the application and blending elements allow the process of transferring, distributing and blending the application material onto the surface to be performed with both elements on a single application assembly. Embodiments of the applicator assembly comprise the application element and the blending element to be made of materials with different characteristics.

It is an object of one embodiment of the invention to provide an applicator assembly having an application element with a proximal end and a distal end, a blending element having a proximal and a distal end and a retaining element positioning the application and blending element adjacent to each other and exposing the distal ends of the application and blending elements. In embodiments of the applicator assembly, the application element comprises a material configured to retain an application material and distribute the application material on a surface and the blending element comprises a material configured to distribute the application material on the surface.

It is another object of embodiments of the invention to provide an applicator assembly wherein the application element material further comprises a material having a characteristic to temporarily retain the application material that is greater than a characteristic of the blending element material to temporarily retain the application material.

It is a further object of one embodiment of the invention to provide an applicator assembly wherein the application element comprises a first plurality of bristles having a first set of bristle characteristics and the blending element comprises a second plurality of bristles having a second set of bristle characteristics. In some embodiments, the application element comprises a first plurality of synthetic bristles, the blending element comprises a second plurality natural bristles and the application material is a liquid or a cream. In some embodiments, the application element comprises a first plurality of natural bristles, the blending element comprises a second plurality of synthetic bristles and the application material is a powder.

It is an object of the one embodiment of the invention to provide an applicator assembly wherein the application material is a cosmetic, the surface is a skin surface of a user, the first plurality of bristles is used to retain a portion of the cosmetic and transfer the cosmetic on the skin surface of the user and the second plurality of bristles is used to distribute the cosmetic on the skin of the user.

It is a further object of embodiments of the invention to provide an applicator assembly where the application or blending elements comprise a resilient porous material.

It is yet another object of one embodiment of the invention to provide an applicator assembly wherein the distal ends of application element and the blending element form a tip plane at an angle ranging from about 20 to 90 degrees to a longitudinal axis of the applicator assembly.

It is an object of one embodiment of the invention to provide an applicator assembly having a first bundle of a plurality of bristles with a first set of bristle characteristics, a second bundle of a plurality of bristles with a second set of bristle characteristics and a ferrule retaining the first and second bundle adjacent to each other.

It is an object of one embodiment of the invention to provide a method of applying a material to a surface comprising the steps of retaining an application material in an application element, transferring the application material from the application element onto a surface, distributing the application material onto the surface with a blending element and the steps of transferring and distributing the application material are performed with an application assembly comprising both the application element and the blending element.

It is another object of one embodiment of the invention to provide a method of applying a material to a surface where the material is a paint.

BRIEF DESCRIPTION OF THE SEVERAL VIEWS OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 2A illustrates a front view of one embodiment of an applicator assembly;

FIG. 2B illustrates a rear view of one embodiment of an applicator assembly;

FIG. 2C illustrates a right view of one embodiment of an applicator assembly;

FIG. 2D illustrates a left view of one embodiment of an applicator assembly;

DETAILED DESCRIPTION OF THE INVENTION

An applicator assembly will now be described in detail with reference to the accompanying drawings. It will be appreciated that, while the following description focuses on an assembly that is used for the application of cosmetic on the skin of a user, the systems and methods disclosed herein have wide applicability. For example, the applicator assembly described herein may be readily employed with paints, pigments, dyes or other application materials and other material distribution tools and processes. Notwithstanding the specific example embodiments set forth below, all such variations and modifications that would be envisioned by one of ordinary skill in the art are intended to fall within the scope of this disclosure.

Figure 1:
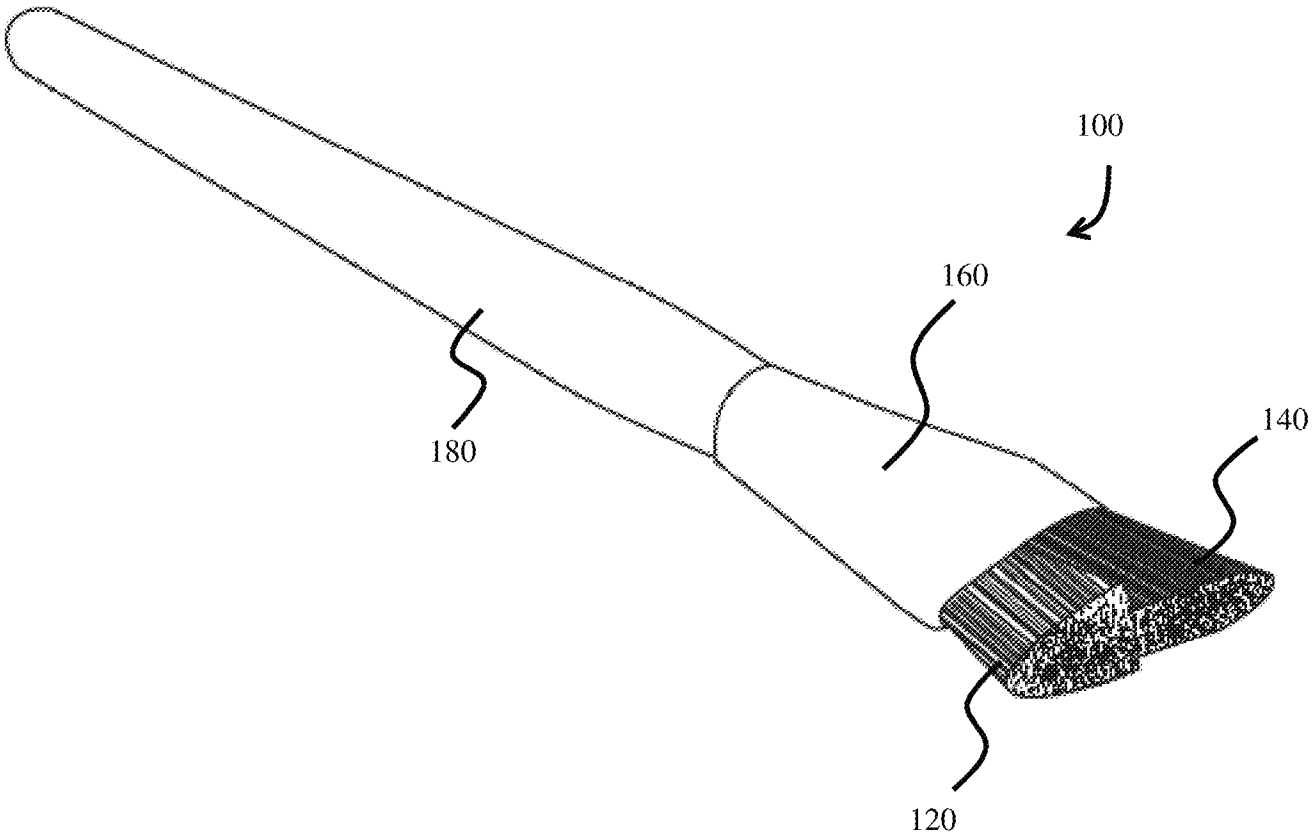
FIG. 1 illustrates a front perspective view of one embodiment of an applicator assembly.

One Embodiment of the Applicator Assembly:

The applicator assembly generally comprises an application element, a blending element and a retaining element. For illustration purposes and not for limitation, one embodiment of the present invention is shown in FIG. 1. As shown in FIG. 1 the applicator assembly 100 comprises an application element 120, a blending element 140, a retaining element 160 and a handle 180. FIG. 2 illustrates other views of the assembly embodiment of FIG. 1.

Referring to FIG. 1, the application element 120 comprises a material with characteristics that allow it to pick up, retain, transfer and distribute an application material onto a surface. This functionality is similar to a cosmetic brush being able to pick up makeup (an application material) from a compact, retain the makeup in the bristles of the brush, transfer the makeup from the compact to the skin of the user and distribute the material on the skin of the user. Similarly, an example of the application element is a paint brush bristle or resilient porous material, such as a sponge, that can take an application material such as paint from a can and allow a user to paint a surface with the paint.

In embodiments, the application element 120 has many characteristics, one of which is a characteristic of being able to retain and/or trap material. The material retaining characteristics are generally the ability of the element to retain portions of an application material and then transfer and distribute the material on a surface. These characteristics may be the result of scale-like outer surface of a natural hair bristle or it may be irregularities on the outer surface, or crimps along the length of a synthetic material that temporarily trap the application material on or in these surfaces.

The material retaining characteristics can be different for different bristle/element types and they may also be different for different application materials. For example, it can be easier for a synthetic bristle to retain a cream or a liquid cosmetic, and it can be easier for a natural bristle to retain a powder cosmetic.

In one embodiment, the application element 120 comprises plurality of elongated synthetic bristles retained in a bundle. The bristles are made of a material such as, but not limited to Nylon.612-DuPont.Tynex, PBT-Tapered&Flagged, PET-Solid.Tapered, PET-Hollow&Flagged, Nylon+Polyester. In addition, the application element can comprise a foam made from, but not limited to a naturally frothed PVA, latex foam rubber, natural rubber, nitrile-butadiene rubber or cellulose.

Referring to FIG. 1, the blending element 140 comprises a material with properties that allow it to also pick up, retain and distribute the application material onto the surface. This functionality is generally similar to the application element 120 with some differences as described below. In embodiments, the properties of being able to distribute the application material is particularly beneficial for the blending element.

As discussed above in relation to the application element 120, embodiments of the blending element 140 include characteristic of being able to retain an application material. Generally, the material retaining characteristics of the blending element are less than the same characteristic of the application element. The blending element allows a generally finer and more blended distribution of the material than the application element. This allows the two elements to work together in embodiments where the blending element primarily transfers and distributes the material onto the surface while the application element primarily retains and transfer the material onto the surface.

In one embodiment, the blending element 140 comprises a plurality of natural hair bristles such as, but not limited to the hair from goats, long haired pigs, ox, sable, raccoon, badger or any of the natural bristle suitable for cosmetic or paint application.

Figure 3:
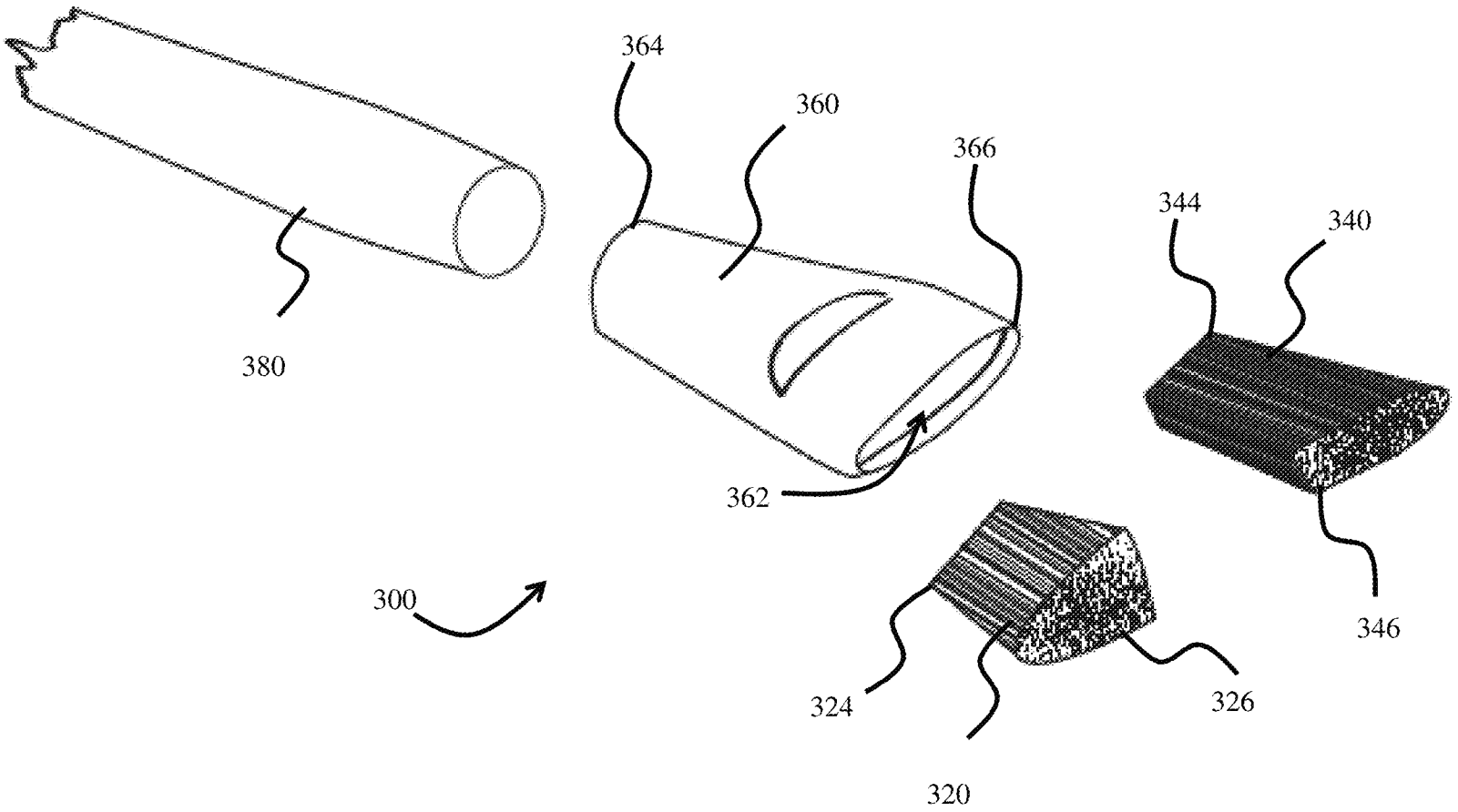
FIG. 3 illustrates a partially exploded perspective view of one embodiment of an applicator assembly.

The retaining element 160 comprises an element configured to retain the application and blending elements together so that they can be manipulated together to apply the material. As shown in the embodiment of FIG. 3, the retaining element 360 is a generally hollow element, such as a ferrule, that retains the elements within and connects the elements to a handle so that they can be manipulated by the hand of a user. As shown in the embodiment of FIG. 3, the retaining element comprises a cylindrical ferrule, with a central bore 362 to retain the application element 320 and the blending element 340. The retaining element 360 has a distal end 366 to receive and retain the proximal ends of the application and blending elements at 324 and 344 respectively. The ferrule also has a proximal end 364 to receive and retain the handle 380. In embodiments, the retaining element 360 allows the application and blending elements to be bundled adjacent to each other so that they create single brush head at the application and blending element distal ends, 326 and 346 respectively. The distal end of the brush head, defined by the distal ends of the application and blending elements, can be shaped as desired.

In some embodiments, as shown in FIG. 2A, the distal ends of the application and blending elements can be shaped to create a tip plane 202 (represented by line 202) where one end of the brush has a shorter distance from the handle than the other when the elements are set in the receiving element. In some embodiments, the tip plane is at an angle 204 ranging from about 20 to 90 degrees to a longitudinal axis 206 (represented by line 206) of the application assembly 200. In some embodiments, the angle ranges from 40 to 80 degrees or preferably from 50 to 70 degrees to the assembly longitudinal axis 206. Although the angle 204 is illustrated as being measure from the side of the longitudinal axis above the blending element 240, it is understood that the angle 204 can be measured from the tip plane 202 on either side of the longitudinal axis 206.

Although embodiments of the application assembly are described as having a tip plane at the distal end of the elements, it is contemplated that the shape of the element distal ends can also be of any shape such as being rounded, pointed or jagged. It is also understood that when a tip plane is used, the angle of that tip plane can be of any angle to the longitudinal axis of the assembly.

The tip plane can be used to provide advantageous properties to the user. For example, as shown in FIG. 2A, if the tip plane formed by the distal end of the application element 220 is a shorter distance from the retaining element than the tip plane formed by the distal end of the blending element 240, the user can stroke the brush in a direction across the surface so that the application element primarily distributes the material and the blending elements help distribute the material all in the same stroke.

Figure 4:
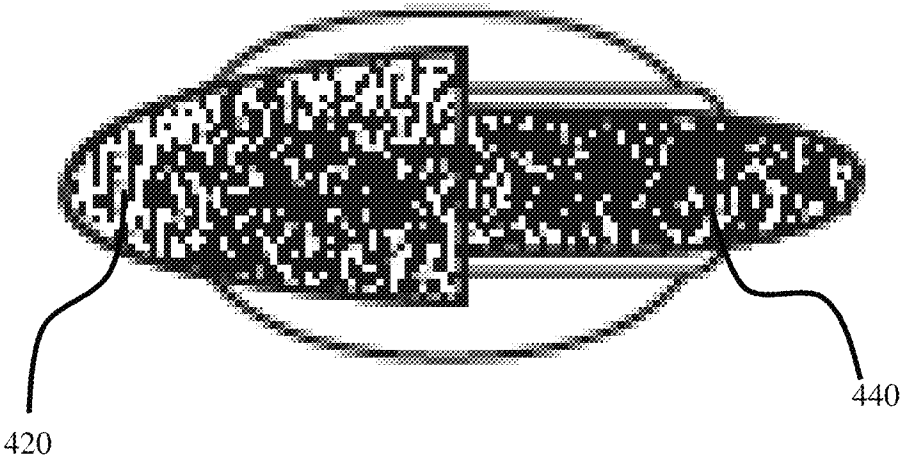
FIG. 4 illustrates a top view of one embodiment of an applicator assembly.

In embodiments, the tip plane can be defined by multiple element tip plane profiles. These element tip plane profiles may be defined by different longitudinal profile shapes of the elements. As shown in FIG. 4, the tip plan profile of the application element 420 is a generally an elliptical shape and it is slightly wider than the generally elliptical shaped profile of the blending element 440. Although the tip plane is shown with two generally elliptical tip plane profiles, it is understood that any shape of the brush head and tip plane profile can be used.

The handle element comprises any configuration that allows a user to manipulate the application and blending elements. One embodiment of the handle is shown in FIGS. 1 and 2A-2D and generally comprises an elongated rod with a body configured to be held in the hand of a user and a distal end to be received and retained in the retaining element. It is understood that generally any shaped handle may be used that will allow a user to manipulate the applicator assembly.

Although some of the embodiments above describe an application element comprising a synthetic material as the application element and a nature material as the blending element, it is understood that embodiments of the applicator assembly can have application elements that are made of natural materials and blending elements made of synthetic materials. Embodiments having synthetic application elements can be helpful for application purposes when the application material is a liquid or a cream. In embodiments where the application material is a powder, is can be beneficial to have the application element being made of natural material such as a bristle or natural hair. This is because some natural materials have better retaining characteristics for powder than synthetic materials. Similarly, because the application material is a powder, synthetic materials can provide a better blending element material. In these embodiments where the blending element is a synthetic material, this material can be any of the materials discussed above for the application element including, but not limited to synthetic bristles, resilient porous materials such as foams or sponges, or the like.

It is also understood that the applicator assembly can have an application element comprising one type of synthetic material and a blending element comprising a second type of synthetic material. As discussed above, by having two types of materials having two material retaining characteristics, the applicator assembly can provide the desired functionality.

One Embodiment of the Applicator Assembly in Operation:

Operation of one embodiment of the applicator assembly generally comprises placing the application element into or in proximity of the application material so that it can pick up and retain a portion of the material, manipulating the application element so that it distributes the material onto the surface and manipulating the blending element so that it further distributes the material.

Figure 5:
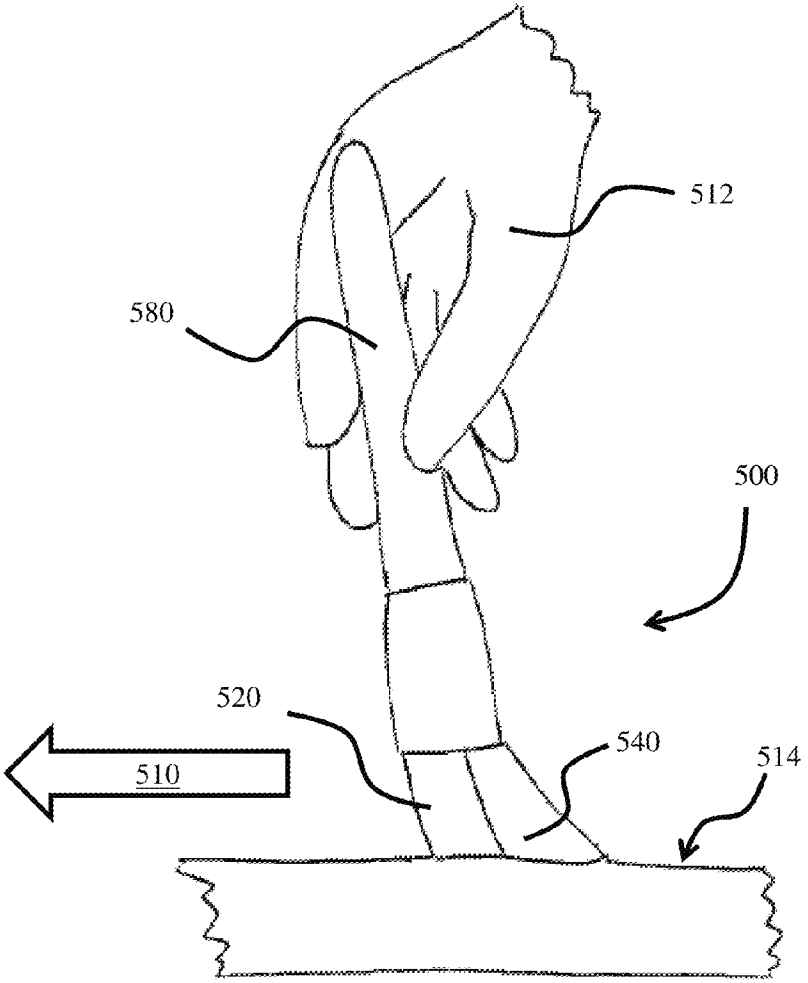
FIG. 5 illustrates one embodiment of a method of using an embodiment of an applicator assembly.

For purposes of illustrating the operation of one embodiment of the applicator assembly, and not for limitation, the operation of an applicator assembly for cosmetics is summarized in FIG. 5. In this operation, the applicator assembly is similar to the embodiments shown in FIGS. 1-4 with a tip plane formed by the distal ends of the application and blending elements.

Figure 6:
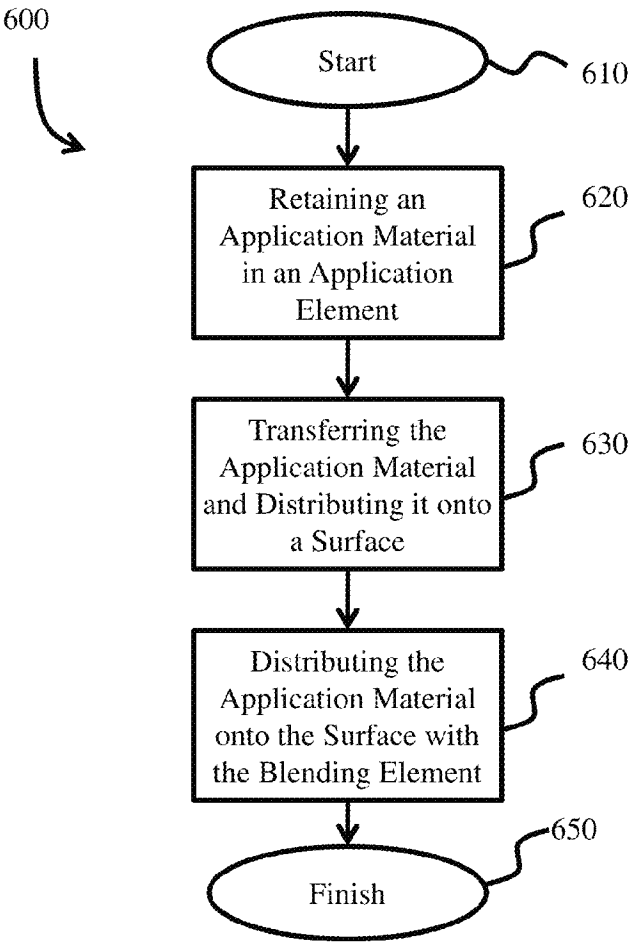
FIG. 6 is a process diagram illustrating one method of using one embodiment of an applicator assembly.

In one embodiment, as shown in the process diagram of FIG. 6, the process 600 of operation starts at step 610 which is followed by with the step 620 of retaining an application material in or on the application element. This step typically involves placing the application element into or in the proximity of the material so that it can be retained in the assembly.

Once the material is retained with the application element, the material is transferred and distributed on the surface at step 630. When used with cosmetics, this distribution is done by stroking the brush across the skin of the user. As shown in FIG. 5, preferably, this stroke is performed in a direction so that the application element's distribution of the material across the surface precedes the blending element's distribution of the material at step 640 of FIG. 6. The transfer and distribution processes of step 630 and 640 allows the application element to be the element that retains the majority of the material and also allows the blending elements to do the final distribution of the material. In embodiments where the blending element has a material retaining characteristic that is less than the application element, the application material is more easily distributed by the blending element.

The process is finished with step 650.

FIG. 5 illustrates one view of the distribution step described above. The applicator assembly 500 is being held in the hand 512 of the user by the handle 580. The assembly 500 has already retained the application material and is being stroked across the surface 514 in a direction 510. In this direction 510, the application element 520 precedes the blending element 540 across the surface 514. This allows the application element 520 to primarily transfer the material to the surface 514 while the blending element 540 completes the distribution of the material to create a more blended distribution.

Figure 8:
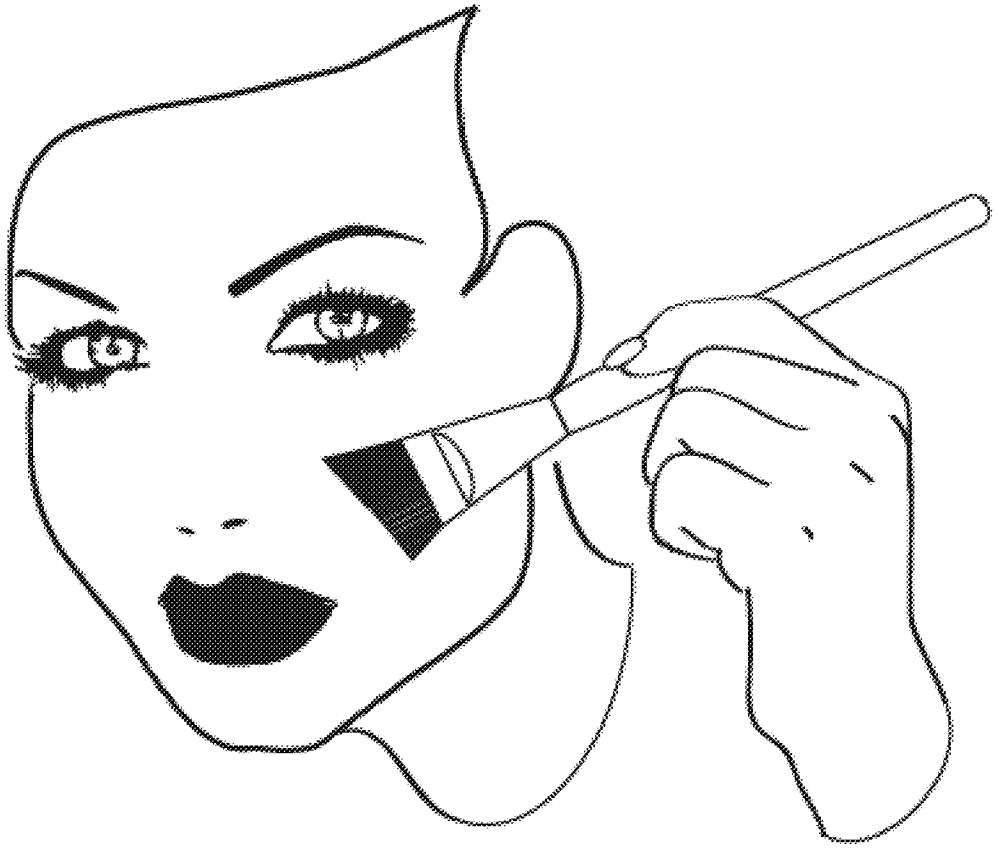
FIG. 8 illustrates another embodiment of a method of using an embodiment of an applicator assembly.

FIG. 8 illustrates one embodiment of the applicator assembly being used to apply facial cosmetics to a user.

The process of distributing the material through a stroke that starts with the application element and finishes with the blending element can be enhanced by the tip shape and profile of the elements. A shorted length of the application element bristles allows them to move across the surface and the longer length of the blending element bristles helps make it easier for the use to ensure these bristles are the last bristles to distribute the material on the surface. The longer length of the blending element also allows the use to stroke the skin surface again with the brush and more easily use the longer blending bristles on the skin.

It is understood that many different variations of using the applicator assembly are possible. Applying the material and distributing the material in a single stroke is possible when the application element precedes the blending element through the stoke. The same type of stroke can be used repeatedly to give the same effect. Also, a multiple stroke process may also be used where generally the stroke pattern allows the transfer and distribution of the material from the application element to precede the distribution and blending of the material. For example, multiple strokes being made in one orientation while the brush moves at an angle to that orientation generally in the direction of the application element. This allows the application element to still be the first element to transfer the material while the blending element is the last element to distribute the material on the surface. It is also understood that circular or random strokes can also allow the blending element to provide the major distribution and blending functions of the assembly.

As can be readily seen by others in the art, the same operational process can be used for embodiments of the assembly where the application and/or blending elements comprise a synthetic or natural resilient porous material such as a sponge. Additionally, it is understood that the same operational process can be used for painting or other similar applications of materials onto a surface.

Figure 7:
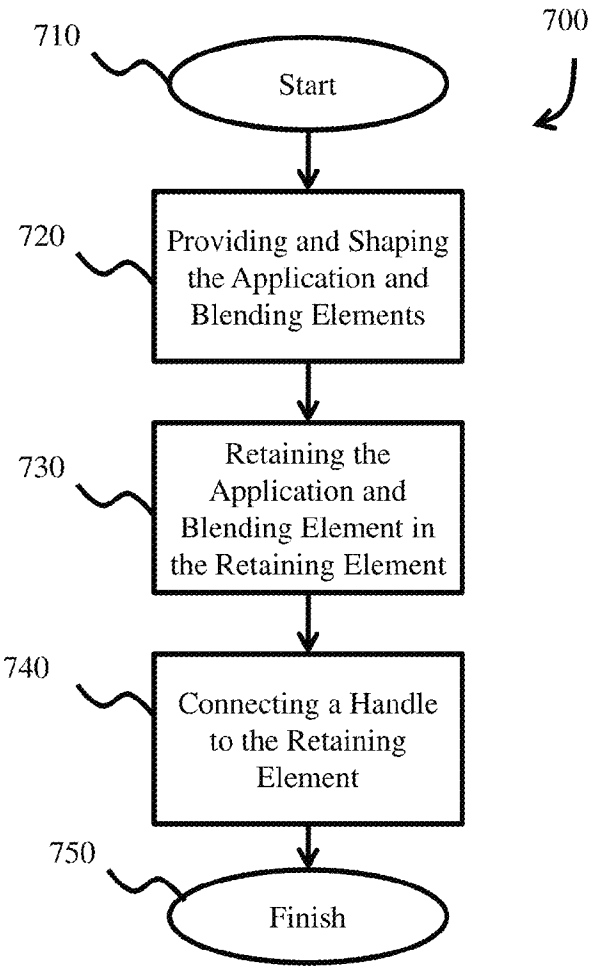
FIG. 7 is a process diagram illustrating one method of manufacturing one embodiment of an applicator assembly.

One Embodiment of a Method of Manufacturing the Applicator Assembly:

For purposes of illustrating the steps of manufacturing one embodiment of the applicator assembly, and not for limitation, the operation of an applicator assembly for cosmetics is summarized below and illustrated in the process diagram for FIG. 7. In this operation, the applicator assembly is similar to the embodiment shown in FIG. 1 with a tip plane formed by the distal ends of the application and blending elements. It is understood that other well known steps and methods in the art can be incorporated into this method of manufacturing.

The method 700 starts at step 710 that is followed by step 720 of providing or otherwise obtaining a first and second set of materials to comprise the application and blending element materials and shaping these elements. The illustrations below describe element materials being bristles.

As part of the shaping, the application and blending elements are bundled by a means to bundle the bristles. In embodiments, the means to bundle the bristles is accomplished by manually or mechanically aligning the bristles along their length with the tips of the bristles aligned to create the distal end of the element. Preferably, the tips of the bristles are aligned so that generally the tips of bristles create the shape desired for the proximal end of the bundle. Once the bristles are aligned, a means to shape the bundle shapes the proximal end of the bundle of bristles. In embodiments, the means to shape the bundle comprises placing the proximal end of the bundle in a sleeve and placing the sleeve and end of the bundle into a shaping cylinder. The sleeve is not necessary but can help guide the bristles into the shaping cylinder. Embodiments of the shaping cylinder comprise a cylinder that can retain the elements while a glue or other retaining means is used to hold the proximal end of the element together. For example, one shaping means comprises the shaping cylinder to be a malleable cylinder than can be bent on one end to deform the cylinder and the proximal end of the bundle of bristles. With this embodiment, once bent to the proper shape, an adhesive can be placed into the other end of the cylinder so that it binds essentially all of the distal ends of the bundle of bristles.

After the bundles are shaped, preferably after the adhesive is dry, the bundles are removed from the shaping cylinder and their proximal ends are placed and retained in the distal end of the retaining element at step 730. The elements are aligned as desired and then they are retained in the retaining element. For embodiments where the retaining element is a metallic brush ferrule, the elements are placed in the ferrule distal end, and the ferrule is used to retain the ends of the elements. In embodiments, the ferrule is deformed to frictionally engage the proximal ends of the elements and an adhesive is added between the inside of the ferrule and the elements. In other embodiments, the ferrule is not deformed and the means to retain the elements is with an adhesive between the application and blending elements and the inside of the retaining element.

In embodiments described herein, the elements are aligned in the retaining element so that the distal ends of the application and the blending element form a tip plane. This plane, as shown in FIG. 3, has the plane formed by the application elements being generally shorter than the plane formed by the ends of the blending element. The alignment of the elements also properly positions the longitudinal profile of the elements.

The retaining element can then be connected to the handle with step 740 by placing an adhesive between the retaining element and the distal end of the handle and inserting the distal end into the retaining element.

The process is complete at step 750.

Generally at any time during this process, the distal ends of the application or blending elements can be cut or otherwise shaped as desired. In embodiments that form a tip plane at the distal ends of the elements, the ends of the elements can be cut to form the tip plane.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Although this invention has been described in the above forms with a certain degree of particularity, it is understood that the present disclosure has been made only by way of example and numerous changes in the details of construction and combination and arrangement of parts may be resorted to without departing from the spirit and scope of the invention.

I claim:

1. An applicator assembly for use in the uptake and application of an application material, said assembly comprising:

a first bundle of a plurality of bristles having a distal end and a proximal end, and a first length from said distal end to said proximal end;

the first bundle having a first affinity for said application material;

a second bundle of a plurality of bristles having a distal end and a proximal end, and a second length from said distal end to said proximal end;

the second bundle having a second affinity for said application material;

wherein said first affinity for said application material is greater than said second affinity for said application material; and a ferrule on the proximal end retaining the first and second bundle adjacent to each other;

wherein the distal ends of the first bundle and the second bundle define a single tip plane at an angle ranging from about 20 to about 90 degrees from a longitudinal axis of the applicator assembly; and wherein said second length is longer than said first length.

2. The applicator assembly of claim 1 wherein the first bundle comprises a first plurality of synthetic bristles and the second bundle comprises a second plurality of natural bristles.

3. The applicator assembly of claim 1 wherein:

the distal end of the first bundle extends a first distance from the ferrule and the distal end of the second bundle extends a second distance from the ferrule; and wherein the second distance is greater than the first distance.

* * * * *